US010107291B2

(12) United States Patent
Ootake et al.

(10) Patent No.: US 10,107,291 B2
(45) Date of Patent: Oct. 23, 2018

(54) FUEL PUMP

(71) Applicant: DENSO CORPORATION, Kariya, Aichi-pref. (JP)

(72) Inventors: Masaya Ootake, Kariya (JP); Tetsuo Hayakawa, Kariya (JP); Kiyoshi Nagata, Kariya (JP)

(73) Assignee: DENSO CORPORATION, Kariya (JP)

( * ) Notice: Subject to any disclaimer, the term of this patent is extended or adjusted under 35 U.S.C. 154(b) by 353 days.

(21) Appl. No.: 14/912,485

(22) PCT Filed: Sep. 3, 2014

(86) PCT No.: PCT/JP2014/004531

§ 371 (c)(1),
(2) Date: Feb. 17, 2016

(87) PCT Pub. No.: WO2015/040813

PCT Pub. Date: Mar. 26, 2015

(65) Prior Publication Data

US 2016/0201679 A1 Jul. 14, 2016

(30) Foreign Application Priority Data

Sep. 17, 2013 (JP) ..... 2013-191598

(51) Int. Cl.
*F04D 13/06* (2006.01)
*F04D 3/00* (2006.01)
(Continued)

(52) U.S. Cl.
CPC ..... *F04D 13/06* (2013.01); *F02M 37/08* (2013.01); *F04D 3/00* (2013.01); *F04D 5/002* (2013.01);
(Continued)

(58) Field of Classification Search
CPC . F04D 13/06; F04D 3/00; F04D 5/002; F04D 13/0693; F04D 29/528; F02M 37/08; F02M 2037/082; F05D 2260/602
See application file for complete search history.

(56) References Cited

U.S. PATENT DOCUMENTS 5,141,410 A * 8/1992 Fujii ..... F02M 37/08 417/423.7
5,520,547 A * 5/1996 Hamaoka ..... F02M 37/10 439/206
(Continued)

FOREIGN PATENT DOCUMENTS

JP 56-105272 8/1981
JP 3-45065 4/1991
(Continued)

OTHER PUBLICATIONS

International Search Report and Written Opinion of the ISA for PCT/JP2014/004531 dated Dec. 9, 2014, 9 pages.

*Primary Examiner* — Kenneth J Hansen
*Assistant Examiner* — Benjamin Doyle
(74) *Attorney, Agent, or Firm* — Nixon & Vanderhye P.C.

(57) ABSTRACT

Partitioned chambers of an electric connector, which receive connection terminals electrically connected to windings of a stator, are communicated with an outside of the electric connector through primary communication holes. The primary communication holes are formed to direct at least one of perpendicular directions, each of which is perpendicular to a corresponding one of opening planes of outside openings of the primary communication holes, toward a downside when a central axis of a fuel pump is tilted relative to a vertical direction. In this way, a foreign object, which is accumulated in any of the portioned chambers, can be
(Continued)

outputted to the outside through the primary communication hole even when the fuel pump is tilted in any direction.

6 Claims, 4 Drawing Sheets

(51) Int. Cl.
*F04D 29/52* (2006.01)
*F02M 37/08* (2006.01)
*F04D 5/00* (2006.01)

(52) U.S. Cl.
CPC ..... *F04D 13/0693* (2013.01); *F04D 29/528* (2013.01); *F02M 2037/082* (2013.01); *F05D 2260/602* (2013.01)

(56) References Cited

U.S. PATENT DOCUMENTS 5,762,481 A * 6/1998 Oi ..... F02M 37/10 417/423.14
5,924,893 A * 7/1999 Eidsvig ..... H01R 13/74 439/206
6,375,500 B1 * 4/2002 Murakami ..... H01R 13/5205 439/196
7,195,466 B2 * 3/2007 Kobayashi ..... F02M 37/048 310/237
8,075,325 B1 * 12/2011 Kao ..... H01R 13/5227 438/141
8,202,069 B2 * 6/2012 Takagi ..... F04B 17/03 417/410.1
8,257,101 B2 * 9/2012 Ichio ..... H01R 13/4367 439/206
8,597,039 B2 * 12/2013 Osawa ..... H01R 13/5227 439/205
8,651,832 B2 * 2/2014 Ito ..... F02M 37/08 417/410.1
8,662,910 B2 * 3/2014 Ichio ..... H01R 13/5208 439/206
9,352,660 B2 * 5/2016 Osawa ..... B60L 11/1818
9,601,864 B2 * 3/2017 Schmidt ..... H01R 13/5202
9,640,900 B2 * 5/2017 Moseke ..... H01R 13/5227
2004/0253125 A1 * 12/2004 Kobayashi ..... F02M 37/048 417/410.1
2005/0079742 A1 * 4/2005 Shimizu ..... H01R 43/18 439/65
2008/0160806 A1 * 7/2008 Ma ..... H01R 12/89 439/153
2009/0297364 A1 * 12/2009 Takagi ..... F02M 37/08 417/48
2011/0020154 A1 * 1/2011 Matsuda ..... H02K 1/148 417/410.1
2011/0229355 A1 9/2011 Hara et al.
2012/0027629 A1 * 2/2012 Tanahashi ..... F04D 5/002 417/410.1
2012/0051954 A1 * 3/2012 Asai ..... F02M 37/048 417/410.1
2015/0107105 A1 * 4/2015 Sakai ..... F04D 13/06 29/888.02
2016/0201679 A1 * 7/2016 Ootake ..... F02M 37/08 417/423.1
2016/0238016 A1 * 8/2016 Sakai ..... F04D 5/002

FOREIGN PATENT DOCUMENTS

JP 10-199611 7/1998
JP 11-159412 6/1999
JP 2010-086806 4/2010
JP 2010-244855 10/2010
WO WO 2015/040811 3/2015
WO WO 2015/040812 3/2015
WO WO 2015/040814 3/2015

* cited by examiner

FUEL PUMP

CROSS REFERENCE TO RELATED APPLICATION

This application is the U.S. national phase of International Application No. PCT/JP2014/004531 filed on Sep. 3, 2014 and is based on and incorporates herein by reference Japanese Patent Application No. 2013-191598 filed on Sep. 17, 2013.

TECHNICAL FIELD

The present disclosure relates to a fuel pump.

BACKGROUND ART

There is known a fuel pump that includes an impeller, which is rotatable in a pump chamber, and a motor, which can drive the impeller to rotate the impeller. The fuel pump pumps fuel of a fuel tank to an internal combustion engine through rotation of the impeller. The fuel pump has an electric connector, which receives an electric power to be supplied to the motor. The Patent Literature 1 recites a fuel pump that has an electric connector, which includes communication holes, and water or the like, which is accumulated in an inside of the electric connector, is outputted to the outside of the electric connector through the communication holes.

However, in the fuel pump of the Patent Literature 1, outside openings of the communication holes are formed to enable outputting of the foreign object, such as the water, to the outside of the electric connector only in a single direction. Therefore, it could happen that the foreign object, such as the water, which is accumulated in the inside of the electric connector, cannot be outputted to the outside of the electric connector depending on the tilting direction of the fuel pump. Therefore, connection terminals, which are made of metal and are received in the inside of the electric connector, may possibly corrode with the foreign object, such as the water.

CITATION LIST

Patent Literature

PATENT LITERATURE 1: JP2012-055054A (corresponding to US2012/0051954A1)

SUMMARY OF INVENTION

It is an objective of the present disclosure to provide a fuel pump, which can limit corrosion of connection terminals that receive an electric power form an outside.

According to the present disclosure, there is provided a fuel pump that includes: a pump case; a stator, around which a plurality of windings is wound and which is received in an inside of the pump case; a rotor; a shaft; an impeller; and an electric connector. The electric connector is provided to the pump case and includes: a receiving chamber, which receives a plurality of connection terminals that receive an electric power to be supplied to the plurality of windings; and a plurality of primary communication holes, each of which communicates between an inside and an outside of the receiving chamber. The plurality of primary communication holes is formed to direct at least one of perpendicular directions, each of which is perpendicular to a corresponding one of opening planes of outside openings of the plurality of primary communication holes, toward a downside when a central axis of the pump case is tilted relative to a vertical direction.

In the fuel pump of the present disclosure, the plurality of connection terminals, which receive the electric power, is received in the receiving chamber of the electric connector. The electric connector includes the plurality of primary communication holes, each of which communicates between the inside and the outside of the receiving chamber. The plurality of primary communication holes is formed to direct the at least one of the perpendicular directions, each of which is perpendicular to the corresponding one of the opening planes of the outside openings of the plurality of primary communication holes, toward the downside when the central axis of the pump case is tilted relative to the vertical direction. Here, each of the opening planes refers to a corresponding imaginary plane that extends through all of points located along a peripheral edge of the corresponding opening. With the above construction, when the central axis of the pump case is tilted in any of directions, a foreign object, which is accumulated in the receiving chamber of the electric connector, is outputted to the outside of the electric connector through the primary communication hole(s). Therefore, in the fuel pump of the present disclosure, it is possible to limit the occurrence of corrosion and/or short circuit of the connection terminals caused by the foreign object, such as the water.

A downward side inner wall (bottom wall) of the receiving chamber may decline from an upside to the downside from a location of each of the plurality of connection terminals toward at least one of the plurality of primary communication holes. With this construction, even when the central axis of the pump case is not tilted, the foreign object, such as the water, accumulated in the receiving chamber of the electric connector, can be effectively outputted through the corresponding primary communication hole(s).

DESCRIPTION OF EMBODIMENTS

Hereinafter, an embodiment of the present disclosure will be described with reference to the accompanying drawings.

A fuel pump according to the embodiment of the present disclosure will be described with reference to FIGS. 1 to 4.

Figure 1:
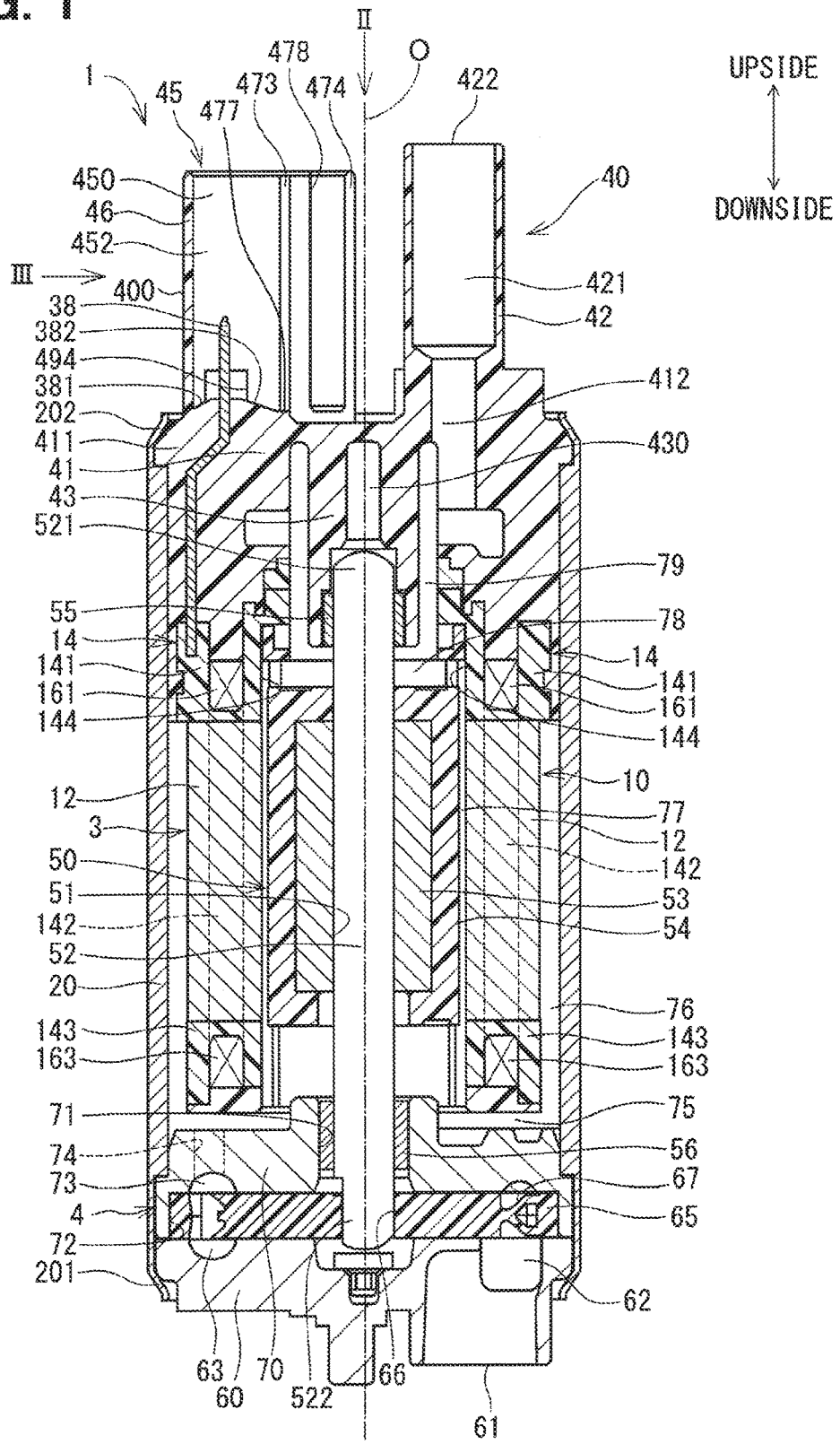
FIG. 1 is a cross-sectional view of a fuel pump according to an embodiment of the present disclosure.
Figure 2:
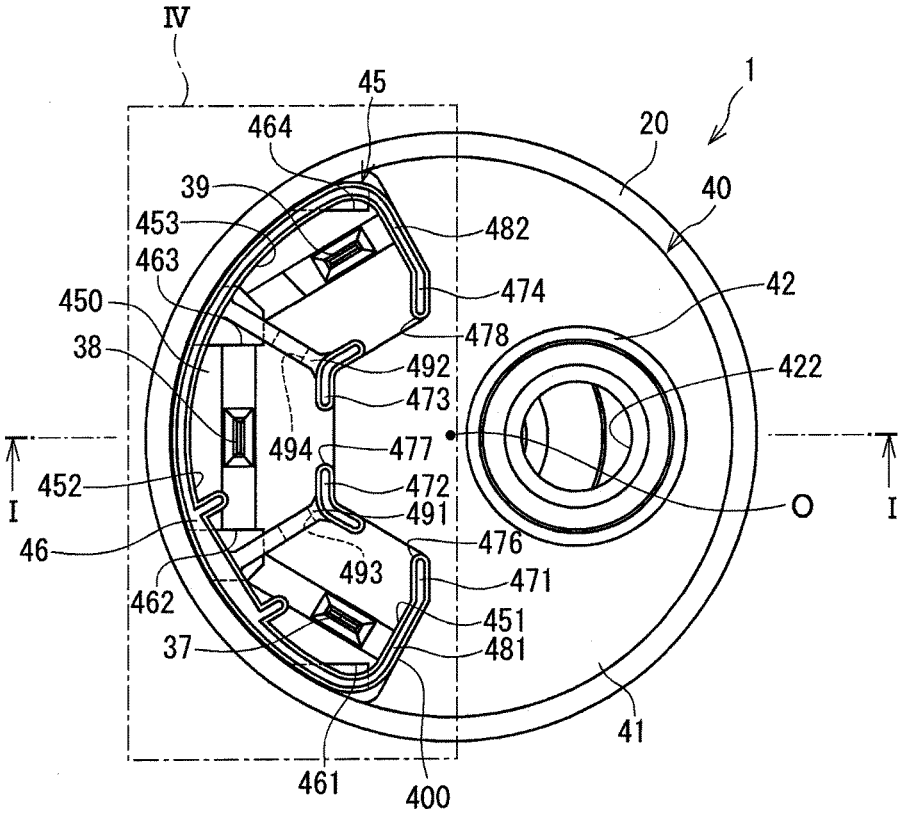
FIG. 2 is a view, which shows the fuel pump of FIG. 1 and is taken in a direction of an arrow II in FIG. 1.

FIG. 1 is a cross-sectional view taken along line I-I in FIG. 2. As shown in FIG. 1, the fuel pump 1 includes a motor arrangement 3, a pump arrangement 4, a housing 20, a pump cover 60, a cover end 40 and an electric connector 45. In the fuel pump 1, the motor arrangement 3 and the pump arrangement 4 are received in a space, which is formed by the housing 20, the pump cover 60 and the cover end 40. The fuel pump 1 draws fuel from a fuel tank (not shown) through a suction port 61, which is indicated at a lower side of FIG. 1, and the fuel pump 1 discharges the drawn fuel toward an internal combustion engine through a discharge port 422, which is indicated at an upper side in FIG. 1. In FIGS. 1 to 4, the upper side will be referred to as "an upside", and the lower side will be referred to as "a downside." The housing 20, the pump cover 60 and the cover end 40 serve as a pump case of the present disclosure.

The housing 20 is configured into a cylindrical tubular form and is made of metal (e.g., iron).

The pump cover 60 closes an end portion 201 of the housing 20, which is located on a side where the suction port 61 is placed. The pump cover 60 is fixed to the housing 20 by crimping a peripheral edge of the end portion 201 of the housing 20 against the pump cover 60 placed on a radially inner side of the end portion 201, and thereby removal of the pump cover 60 from the housing 20 in an axial direction of a central axis O of the housing 20, i.e., an axial direction of a central axis O of the fuel pump 1 is limited.

The cover end 40 is made of resin and closes an end portion 202 of the housing 20 located on a side where the discharge port 422 is placed. The cover end 40 includes a base portion 41, a discharge portion 42 and a bearing receiving portion 43.

The base portion 41 is placed to close the end portion 202 of the housing 20. The base portion 41 is connected to an upside portion of a stator 10 of the motor arrangement 3 and is formed to be integrated with the stator 10. A peripheral edge of the end portion 202 of the housing 20 is crimped against a radially outer side edge part 411 of the base portion 41. In this way, the base portion 41 is fixed in the inside of the housing 20, so that removal of the base portion 41 in the axial direction of the central axis O of the fuel pump 1 is limited. A fuel passage 412 is formed in the base portion 41 at a location, which is displaced from a center of the base portion 41. The fuel passage 412 is communicated with a fuel passage 421 of the discharge portion 42. The discharge portion 42 is connected to a part of the base portion 41 located at the outside of the housing 20.

The discharge portion 42 is configured into a generally tubular form and extends to the outside of the housing 20 at the location, which is displaced from the center of the base portion 41. The discharge portion 42 includes the fuel passage 421 and the discharge port 422. The fuel at the inside of the housing 20 flows through the fuel passage 421.

The bearing receiving portion 43 is configured into a generally tubular form having a bottom. The bearing receiving portion 43 extends from a generally center part of the base portion 41 toward the interior of the housing 20. The bearing receiving portion 43 includes a receiving space 430. The receiving space 430 receives an end portion 521 of the shaft 52 and a bearing 55, which rotatably supports the end portion 521 of the shaft 52.

The electric connector 45 is placed on an opposite side of the center of the base portion 41, which is opposite from the discharge portion 42. The electric connector 45 is configured into a tubular form having a bottom. An internal space of the electric connector 45 forms a receiving chamber 450, which receives three connection terminals 37, 38, 39. The receiving chamber 450 is partitioned into three partitioned chambers 451, 452, 453, which receive the three connection terminals 37, 38, 39, respectively. The details of the structure of the electric connector 45 will be described later.

The motor arrangement 3 includes the stator 10, a rotor 50 and the shaft 52. The motor arrangement 3 is a brushless motor. When an electric power is supplied to the stator 10, a magnetic field is generated at the stator 10. Thereby, the rotor 50 is rotated together with the shaft 52.

The stator 10 is configured into a cylindrical tubular form and is received at a radially outer side location in the inside of the housing 20. The stator 10 includes six cores 12, six bobbins, six windings and the three connection terminals. The stator 10 is integrally formed through insert molding of these components with resin.

Each core 12 is formed by stacking a plurality of plates, which are made of a magnetic material (e.g., iron). The cores 12 are arranged one after another in a circumferential direction and are placed at a location where the cores 12 oppose a magnet 54 of the rotor 50.

The bobbins 14 are made of a resin material. At the time of manufacturing, the cores 12 are inserted into and integrated with the bobbins 14, respectively. Each bobbin 14 includes an upper end portion 141, an insert portion 142 and a lower end portion 143. The upper end portion 141 is formed on the discharge port 422 side. Each core 12 is inserted into the insert portion 142 of the corresponding bobbin 14. The lower end portion 143 is formed on the suction port 61 side.

Each of the windings is, for example, a copper wire that has an outer surface coated with a dielectric film. Each winding is wound around the corresponding bobbin 14, into which the core 12 is inserted, to form one coil. Each winding includes an upper end winding portion 161, an insert winding portion (not shown) and a lower end winding portion 163. The upper end winding portion 161 is wound around the upper end portion 141 of the corresponding bobbin 14. The insert winding portion is wound around the insert portion 142 of the bobbin 14. The lower end winding portion 163 is wound around the lower end portion 143 of the bobbin 14. Each of the windings is electrically connected to a corresponding one of the three connection terminals 37, 38, 39 placed at the upside portion of the fuel pump 1.

The three connection terminals 37, 38, 39 are fixed to the base portion 41 of the cover end 40. The three connection terminals 37, 38, 39 receive a three-phase electric power from an electric power source device (not shown).

The rotor 50 is rotatably received on the inner side of the stator 10. The rotor 50 includes the magnet 54, which is placed to surround an iron core 53. The magnet 54 has N-poles and S-poles, which are alternately arranged one after another in the circumferential direction. In the present embodiment, the number of the N-poles is two, and the number of the S-poles is two.

The shaft 52 is securely press fitted into a shaft hole 51 of the rotor 50, which extends along a rotational axis of the rotor 50, and the shaft 52 is rotated integrally with the rotor 50.

Next, the structure of the pump arrangement 4 will be described.

The pump cover 60 includes the suction port 61, which is in a tubular form and opens toward the downside. A suction passage 62 is formed in an inside of the suction port 61 to extend through the pump cover 60 in the axial direction of the rotational axis of the shaft 52.

A pump casing 70, which is configured into a generally circular plate form, is placed between the pump cover 60 and the stator 10. A through-hole 71 is formed in a center part of the pump casing 70 to extend through the pump casing 70 in a plate thickness direction of the pump casing 70. A bearing 56 is fitted into the through-hole 71. The bearing 56 rotatably supports an end portion 522 of the shaft 52, which is placed at a pump chamber 72 side. In this way, the rotor 50 and the shaft 52 are rotatable relative to the cover end 40 and the pump casing 70.

The impeller 65 is made of resin and is configured into a generally circular plate form. The impeller 65 is received in the pump chamber 72, which is formed between the pump cover 60 and the pump casing 70. The end portion 522 of the shaft 52 is configured into a D-shape that is formed by cutting a part of an outer wall of the end portion 522 of the shaft 52. The end portion 522 of the shaft 52 is fitted into a corresponding hole 66, which is configured into a D-shape and is formed at the center part of the impeller 65. In this way, the impeller 65 is rotated in the pump chamber 72 through the rotation of the shaft 52.

A groove 63, which is communicated with the suction passage 62, is formed in the impeller 65 side surface of the pump cover 60. A groove 73 is formed in the impeller 65 side surface of the pump casing 70. A fuel passage 74, which extends through the pump casing 70 in the axial direction of the rotational axis of the shaft 52, is communicated with the groove 73. The impeller 65 includes blades 67 at a location which corresponds to the groove 63 and the groove 73.

In the fuel pump 1, when the electric power is supplied to the windings of the motor arrangement 3 through the connection terminals 37, 38, 39, the impeller 65 is rotated along with the rotor 50 and the shaft 52. When the impeller 65 is rotated, the fuel in the fuel tank, which receives the fuel pump 1, is guided to the groove 63 through the suction port 61. The fuel, which is guided to the groove 63, is pressurized through the rotation of the impeller 65 and is guided to the groove 73. The pressurized fuel is guided to an intermediate chamber 75, which is formed between the pump casing 70 and the motor arrangement 3, through the fuel passage 74.

The fuel, which is guided to the intermediate chamber 75, is conducted through a fuel passage 77, which is formed between the rotor 50 and the stator 10, a fuel passage 78, which is formed between an outer wall of the shaft 52 and inner walls 144 of the bobbins 14, and a fuel passage 79, which is formed between the base portion 41 of the cover end 40 and the bearing receiving portion 43. Furthermore, a portion of the fuel, which is guided to the intermediate chamber 75, is conducted through a fuel passage 76 that is formed between the housing 20 and the stator 10. The fuel, which has passed through the fuel passages 76, 77, 78, is guided into the fuel passage 412. The fuel, which is guided into the fuel passage 412, is discharged to the outside through the fuel passage 421 and the discharge port 422.

Figure 3:
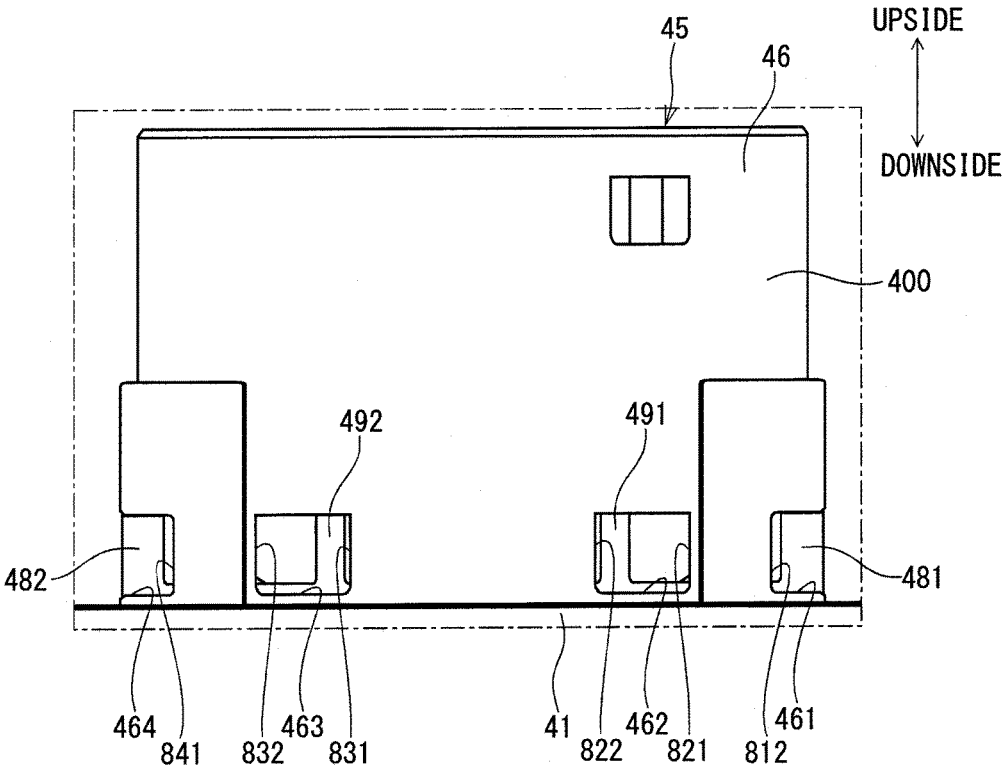
FIG. 3 is a view, which shows the fuel pump of FIG. 1 and is taken in a direction of an arrow III in FIG. 1.
Figure 4:
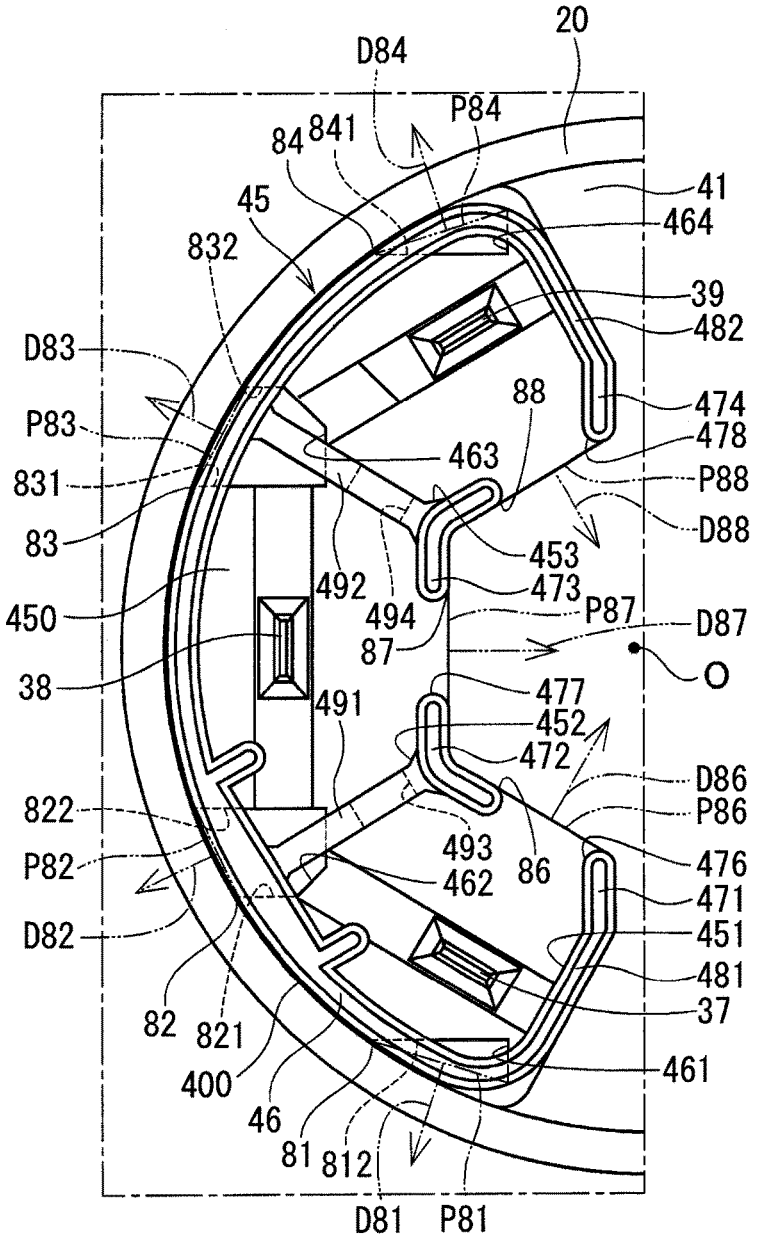
FIG. 4 is a partial enlarged view of an area IV in FIG. 2.

The fuel pump 1 of the present embodiment has a characteristic feature in the configuration of the electric connector 45. The configuration of the electric connector 45 will be described in detail with reference to FIGS. 2 to 4. FIG. 2 is a schematic view seen from the upside of the cover end 40, which includes the electric connector 45. FIG. 3 is a schematic view of the electric connector 45 seen from the radially outer side of the fuel pump 1. FIG. 4 is a partial enlarged view of a portion IV of FIG. 2.

The electric connector 45 includes an outside wall 46, four inside walls 471, 472, 473, 474, two connection walls 481, 482, and two partition walls 491, 492. The outside wall 46, the inside walls 471, 472, 473, 474, and the connection walls 481, 482 form an outer peripheral wall 400, which extends along an outer peripheral edge of the electric connector 45.

The outside wall 46 is formed on a radially outer side of the cover end 40 and extends along a generally arcuate shape of the housing 20. The outside wall 46 includes primary communication holes 461, 462, 463, 464, which communicate between the inside and the outside of the electric connector 45. As shown in FIG. 3, the primary communication holes 461, 462, 463, 464 are formed at a downside portion of the outside wall 46, i.e., a connecting side end portion of the outside wall 46, at which the electric connector 45 is connected to the base portion 41. Each of the four primary communication holes 461, 462, 463, 464 opens outwardly in a radial direction away from the central axis O.

As shown in FIG. 4, the primary communication hole 461 communicates between the partitioned chamber 451 and the outside of the electric connector 45. An imaginary plane, which extends through all of points located along a peripheral edge of an outside opening 81 of the primary communication hole 461, is defined as an opening plane P81. In such a case, a perpendicular direction, which is perpendicular to the opening plane P81, is a direction D81, which is indicated by a dot-dot-dash line.

The primary communication hole 462 communicates the partitioned chambers 451, 452 to the outside of the electric connector 45. An imaginary plane, which extends through all of points located along a peripheral edge of an outside opening 82 of the primary communication hole 462, is defined as an opening plane P82. In such a case, a perpendicular direction, which is perpendicular to the opening plane P82, is a direction D82, which is indicated by a dot-dot-dash line and is different from the direction D81.

The primary communication hole 463 communicates the partitioned chambers 452, 453 to the outside of the electric connector 45. An imaginary plane, which extends through all of points located along a peripheral edge of an outside opening 83 of the primary communication hole 463, is defined as an opening plane P83. In such a case, a perpendicular direction, which is perpendicular to the opening plane P83, is a direction D83, which is indicated by a dot-dot-dash line and is different from the directions D81, D82.

The primary communication hole 464 communicates the partitioned chamber 453 to the outside of the electric connector 45. An imaginary plane, which extends through all of points located along a peripheral edge of an outside opening 84 of the primary communication hole 464, is defined as an opening plane P84. In such a case, a perpendicular direction, which is perpendicular to the opening plane P84, is a direction D84, which is indicated by a dot-dot-dash line and is different from the directions D81, D82, D83.

Furthermore, as shown in FIGS. 3 and 4, a side wall 812, which forms the primary communication hole 461, side walls 821, 822, which form the primary communication hole 462, side walls 831, 832, which form the primary communication hole 463, and a side wall 841, which forms the primary communication hole 464, are formed to be parallel to each other. Here, the term "parallel" does not necessarily refer to exact parallel but may refer to that the side walls stay in some degree of parallel relationship to each other, which can be recognized as parallel.

The inside walls 471, 472, 473, 474 are arranged such that the inside walls 471, 472, 473, 474 are placed at a radially inner side portion of the cover end 40 along an arc, which has a radius that is smaller than a radius of an arc of the outside wall 46. The inside walls 471, 472, 473, 474 are connected with each other at downside portions of the inside walls 471, 472, 473, 474 (see FIG. 1).

A primary communication hole 476, which has a length that is measured in the vertical direction and is generally equal to lengths of the inside walls 471, 472 measured in the vertical direction, is formed between the inside wall 471 and the inside wall 472. An imaginary plane, which extends through all of points located along a peripheral edge of an outside opening 86 of the primary communication hole 476, is defined as an opening plane P86. In such a case, a perpendicular direction, which is perpendicular to the opening plane P86, is a direction D86, which is indicated by a dot-dot-dash line and is different from the directions D81, D82, D83, D84.

A primary communication hole 477, which has a length that is measured in the vertical direction and is generally equal to lengths of the inside walls 472, 473 measured in the vertical direction, is formed between the inside wall 472 and the inside wall 473. An imaginary plane, which extends through all of points located along a peripheral edge of an outside opening 87 of the primary communication hole 477, is defined as an opening plane P87. In such a case, a perpendicular direction, which is perpendicular to the opening plane P87, is a direction D87, which is indicated by a dot-dot-dash line and is different from the directions D81, D82, D83, D84, D86.

A primary communication hole 478, which has a length that is measured in the vertical direction and is generally equal to lengths of the inside walls 473, 474 measured in the vertical direction, is formed between the inside wall 473 and the inside wall 474. An imaginary plane, which extends through all of points located along a peripheral edge of an outside opening 88 of the primary communication hole 478, is defined as an opening plane P88. In such a case, a perpendicular direction, which is perpendicular to the opening plane P88, is a direction D88, which is indicated by a dot-dot-dash line and is different from the directions D81, D82, D83, D84, D86, D87. In the fuel pump 1 of the present embodiment, all of the dot-dot-dash lines, which indicate the directions D81, D82, D83, D84, D86, D87, D88, are formed in a common plane. The above three primary communication holes 476, 477, 478 open inwardly in the radial direction toward the central axis O.

The connection wall 481 is formed to extend in the radial direction and connects between an end portion of the outside wall 46, at which the primary communication hole 461 is formed, and the inside wall 471. The connection wall 482 is formed to extend in the radial direction and connects between another end portion of the outside wall 46, at which the primary communication hole 464 is formed, and the inside wall 474.

The partition wall 491 is formed to extend in the radial direction and connects between the outside wall 46 and the inside wall 472. The partition wall 491 partitions the inside of the electric connector 45 into the partitioned chamber 451 and the partitioned chamber 452. A secondary communication hole 493, which communicates between the partitioned chamber 451 and the partitioned chamber 452, is formed at the downside portion of the partition wall 491.

The partition wall 492 is formed to extend in the radial direction and connects between the outside wall 46 and the inside wall 473. The partition wall 492 partitions the inside of the electric connector 45 into the partitioned chamber 452 and the partitioned chamber 453. A secondary communication hole 494, which communicates between the partitioned chamber 452 and the partitioned chamber 453, is formed at the downside portion of the partition wall 492.

Downside inner walls (bottom walls) of the electric connector 45, which are located at the downside portion of the electric connector 45 and which are provided with the connection terminals 37, 38, 39, are tilted such that the corresponding downside inner walls (bottom walls) of the electric connector 45 are tilted from a location, at which a corresponding one of the connection terminals 37, 38, 39 is located, toward the outside (toward the outside on the radially outer side of the electric connector 45 and the outside on the radially inner side of the electric connector 45). Specifically, as shown in FIG. 1, the downside inner walls (bottom walls) 381, 382 of the partitioned chamber 352 are formed to be tilted from the upside to the downside from a location, at which the connection terminal 38 is located, toward the outside of the electric connector 45. Here, although the downside inner walls (bottom walls) of the partitioned chambers 451, 453, which respectively receive the connection terminals 37, 39, are not depicted in the drawings, these downside inner walls (bottom walls) of the partitioned chambers 451, 453 are formed to be tilted from the upside to the downside from the location, at which the corresponding one of the connection terminals 37, 39 is located, toward the outside of the electric connector 45 like the downside inner walls 381, 382 of the partition chamber 452.

In the fuel pump 1 of the present embodiment, the primary communication holes 461, 462, 463, 464, 476, 477, 478, which communicate the partitioned chambers 451, 452, 453 of the electric connector 45 to the outside of the electric connector 45, are formed. As shown in FIG. 4, at each of the primary communication holes 461, 462, 463, 464, 476, 477, 478, the direction D81, D82, D83, D84, D86, D87, D88, which is perpendicular to the opening plane P81, P82, P83, P84, P86, P87, P88 of the primary communication hole 461, 462, 463, 464, 476, 477, 478, extends in the radial direction from the electric connector 45 in the common plane. When the central axis O of the fuel pump 1 is tilted relative to the vertical direction, at least one of the directions D81, D82, D83, D84, D86, D87, D88 of the primary communication holes 461, 462, 463, 464, 476, 477, 478 is tilted toward the downside. In this way, the foreign object, such as water, which is accumulated in the inside of the electric connector 45, is reliably outputted to the outside of the electric connector 45 through at least one of the primary communication holes 461, 462, 463, 464, 476, 477, 478. Therefore, in the fuel pump 1 of the present embodiment, it is possible to limit the corrosion and/or short circuit of the connection terminals 37, 38, 39 that would be caused by the foreign object, such as the water accumulated in the electric connector 45.

In the fuel pump 1, the downside inner walls, which form the partitioned chambers 451, 452, 453, are formed to be tilted such that the corresponding downside inner walls, which form the corresponding one of the partitioned chambers 451, 452, 453, are tilted from the upside to the downside from the location, at which the corresponding one of the connection terminals 37, 38, 39 is located, toward the outside of the electric connector 45. In this way, the foreign object, such as the water, which is present in any of the partitioned chambers 451, 452, 453, flows along the downside inner walls 381, 382 from the upside to the downside and is outputted to the outside through the corresponding primary communication hole(s) 461, 462, 463, 464, 476, 477, 478. Thereby, even when the central axis O of the fuel pump 1 is not tilted relative to the vertical direction, the foreign object, such as the water accumulated in the inside of the electric connector 45, can be effectively outputted to the outside. As a result, it is possible to further limit the occurrence of the corrosion and/or the short circuit of the connection terminals 37, 38, 39 that would be caused by the foreign object, such as the water, which is accumulated in the electric connector 45.

Furthermore, each of the partition walls 491, 492, which partition the inside of the electric connector 45 into the partitioned chambers 451, 452, 453, has the corresponding one of the secondary communication hole 493, which communicates between the partitioned chamber 451 and the partitioned chamber 452, and the secondary communication hole 494, which communicates between the partitioned chamber 452 and the partitioned chamber 453. In this way, the foreign object, such as the water, which is accumulated in any particular one of the partitioned chambers, flows to another one of the partitioned chambers, which is located on the downside of the particular one of the partitioned chambers, and is outputted to the outside through the primary communication hole of the other one of the partitioned chambers when the fuel pump 1 is tilted. As a result, it is possible to further limit the occurrence of the corrosion of the connection terminals 37, 38, 39 that would be caused by the foreign object, such as the water, which is accumulated in the electric connector 45.

Furthermore, the multiple communication holes, which include the primary communication holes and the secondary communication hole(s), are formed at each one of the partitioned chambers and are directed to different directions. In this way, a flow of the air can be easily formed in the partitioned chambers. Thereby, the foreign object, such as the water, can be easily flown to primary hole(s) and/or the secondary hole(s), and the partitioned chambers can be easily dried. As a result, it is possible to further limit the occurrence of the corrosion of the connection terminals 37, 38, 39 that would be caused by the foreign object, such as the water, which is accumulated in the electric connector 45.

Furthermore, in the fuel pump 1, the side wall 812, which forms the primary communication hole 461, the side walls 821, 822, which form the primary communication hole 462, the side walls 831, 832, which form the primary communication hole 463, and the side wall 841, which forms the primary communication hole 464, are formed to be parallel to each other. Thereby, in the case where the electric connector 45 is molded with a mold together with the base portion 41, the primary communication holes 461, 462, 463, 464 can be molded by pulling a mold segment of the mold, which forms the primary communication holes 461, 462, 463, 464, in one direction, more specifically a direction that is parallel to the side walls 812, 821, 822, 831, 832, 841. Therefore, the cover end 40, which has the multiple communication holes, can be easily formed.

Other Embodiments (1) In the above embodiment, the directions, each of which is perpendicular to the opening plane of the outside opening of the corresponding one of the seven primary communication holes, are formed in the common plane. However, these directions need not be formed in the common plane. It is only required that at least one of these directions is directed toward the downside when the central axis of the fuel pump is tilted relative to the vertical direction.

(2) In the above embodiment, the number of the primary communication holes is seven. However, the number of the communication holes, which communicate between the receiving chamber of the electric connector and the outside is not limited to this number.

(3) In the above embodiment, the receiving chamber, which receives the connection terminals, includes the three partitioned chambers. However, the configuration of the receiving chamber is not limited to this configuration. Specifically, the receiving chamber may be formed by a single space, or two partitioned chambers, or four or more partitioned chambers.

(4) In the above embodiment, the number of the secondary communication holes is two. However, the number of the secondary communication holes is not limited to this number. The secondary communication holes may be eliminated, or the number of the secondary communication hole(s) may be one or three or more.

The present disclosure is not limited to the above embodiments, and the above embodiments may be modified in various ways within the principle of the present disclosure.

The invention claimed is:

1. A fuel pump comprising:

a pump case that includes a suction port, through which fuel is drawn into an inside of the pump case, and a discharge port, through which the fuel is discharged to an outside of the pump case;

a stator, around which a plurality of windings is wound, wherein the stator is configured into a tubular form and is received in the inside of the pump case;

a rotor that is rotatably placed on a radially inner side of the stator;

a shaft that is coaxial with the rotor and rotates integrally with the rotor; and an impeller that is provided to one end portion of the shaft, wherein when the impeller is rotated together with the shaft, the impeller pressurizes the fuel drawn through the suction port and discharges the pressurized fuel through the discharge port; and an electric connector that is provided to the pump case and includes:

a receiving chamber, which receives a plurality of connection terminals that receive an electric power to be supplied to the plurality of windings; and a plurality of outer peripheral wall holes, each of which communicates between an inside and an outside of the receiving chamber through an outer peripheral wall of the electric connector, wherein:

the plurality of outer peripheral wall holes is configured such that at least one of perpendicular directions, each of which is perpendicular to a corresponding one of opening planes of outside openings of the plurality of outer peripheral wall holes, is directed toward a downside when a central axis of the pump case is tilted in any direction relative to a vertical direction;

the electric connector includes at least one partition wall, which partitions the receiving chamber into a plurality of partitioned chambers;

the at least one partition wall includes a partition wall hole, which communicates between corresponding adjacent two of the plurality of partitioned chambers; and the plurality of outer peripheral wall holes and the partition wall hole open at an axial height where each of the plurality of connection terminals is exposed from a surface of a downside bottom wall of the receiving chamber.

2. The fuel pump according to claim 1, wherein the plurality of outer peripheral wall holes is formed at a downside portion of the electric connector.

3. The fuel pump according to claim 1, wherein the downside bottom wall of the receiving chamber is formed to decline from an upside to the downside from a location of each of the plurality of connection terminals toward at least one of the plurality of outer peripheral wall holes.

4. The fuel pump according to claim 1, wherein a plurality of side walls, which form at least two of the plurality of outer peripheral wall holes, is formed to be parallel to each other.

5. The fuel pump according to claim 1, wherein at least one of the plurality of outer peripheral wall holes opens inwardly in a radial direction toward the central axis of the pump case, and at least another one of the plurality of outer peripheral wall holes opens outwardly in the radial direction away from the central axis of the pump case.

6. The fuel pump according to claim 1, wherein the partition wall hole and a corresponding one of the plurality of outer peripheral wall holes are continuously formed together as a continuous hole at a connection where the outer peripheral wall and the partition wall are connected.

* * * * *